US010450684B2

(12) United States Patent
Ohashi et al.

(10) Patent No.: US 10,450,684 B2
(45) Date of Patent: Oct. 22, 2019

(54) SEWING QUALITY CONTROL IN SEWING MACHINE

(71) Applicants: TOKAI KOGYO MISHIN KABUSHIKI KAISHA, Kasugai (JP); NSD CORPORATION, Nagoya-shi (JP)

(72) Inventors: Isao Ohashi, Komaki (JP); Koichi Nakamura, Komaki (JP); Yoshichika Takizawa, Kasugai (JP); Masayoshi Ono, Tokai (JP); Hirotsugu Uenishi, Chiryu (JP)

(73) Assignees: TOKAI KOGYO MISHIN KABUSHIKI KAISHA, Kasugai-Shi (JP); NSD CORPORATION, Nagoya-Shi (JP)

( * ) Notice: Subject to any disclaimer, the term of this patent is extended or adjusted under 35 U.S.C. 154(b) by 205 days.

(21) Appl. No.: 15/552,565

(22) PCT Filed: Feb. 23, 2016

(86) PCT No.: PCT/JP2016/055259
§ 371 (c)(1),
(2) Date: Aug. 22, 2017

(87) PCT Pub. No.: WO2016/136737
PCT Pub. Date: Sep. 1, 2016

(65) Prior Publication Data

US 2018/0016723 A1 Jan. 18, 2018

(30) Foreign Application Priority Data

Feb. 25, 2015 (JP) ..... 2015-035099

(51) Int. Cl.
*D05B 45/00* (2006.01)
*D05B 19/12* (2006.01)
(Continued)

(52) U.S. Cl.
CPC ..... *D05B 45/00* (2013.01); *D05B 19/12* (2013.01); *D05B 47/00* (2013.01); *D05B 55/00* (2013.01)

(58) Field of Classification Search
CPC .. D05B 45/00; D05B 19/02–16; D05B 47/00; D05B 47/02; D05B 47/04; D05B 55/00
See application file for complete search history.

(56) References Cited

U.S. PATENT DOCUMENTS 4,192,243 A * 3/1980 Blessing ..... D05B 45/00 112/273
4,377,980 A * 3/1983 Hanyu ..... D05B 19/12 112/229
(Continued)

FOREIGN PATENT DOCUMENTS

JP H05212183 A 8/1993
JP H05245285 A 9/1993
(Continued)

OTHER PUBLICATIONS

International Search Report issued in Intl. Appln No. PCT/JP2016/055259 dated Apr. 5, 2016. English translation provided.
(Continued)

*Primary Examiner* — Ismael Izaguirre
(74) *Attorney, Agent, or Firm* — Rossi, Kimms & McDowell LLP

(57) ABSTRACT

Disclosed is a sewing machine which evaluates sewing quality using a stitch tightness index. During sewing operation, a used length of an upper thread per stitch is detected, and a stitch tightness index per sewn stitch is calculated on the basis of a stitch length per stitch defined by sewing pattern data, a fabric thickness of a sewing workpiece, and detected data of the used length of the upper thread. Then, notification is made which corresponds to the calculated stitch tightness index per sewn stitch (such as a visual
(Continued)

display of the stitch tightness index). After that, acceptability/non-acceptability of the thread tightness per sewn stitch can be determined by comparing the calculated stitch tightness index per sewn stitch against a reference value, and a result of the determination can be notified.

7 Claims, 5 Drawing Sheets

(51) Int. Cl.
*D05B 47/00* (2006.01)
*D05B 55/00* (2006.01)

(56) References Cited

U.S. PATENT DOCUMENTS

| | | | | |
|---|---|---|---|---|
| 4,901,656 | A * | 2/1990 | Yoshida | D05B 19/105 112/445 |
| 5,044,292 | A | 9/1991 | Nakamura et al. | |
| 5,189,971 | A * | 3/1993 | Frankel | D05B 57/30 112/220 |
| 5,229,949 | A * | 7/1993 | Kondo | D05B 25/00 112/470.01 |
| 5,953,231 | A * | 9/1999 | Miller | D05B 19/12 700/143 |
| 6,012,405 | A * | 1/2000 | Melton | D05B 19/12 112/254 |
| 6,823,807 | B2 | 11/2004 | Zesch et al. | |
| 2003/0140832 | A1 | 7/2003 | Ton et al. | |

FOREIGN PATENT DOCUMENTS

| | | | |
|---|---|---|---|
| JP | H08224391 | A | 9/1996 |
| JP | 2000334187 | A | 12/2000 |
| JP | 2003164686 | A | 6/2003 |
| JP | 2003305288 | A | 10/2003 |
| JP | 2004201946 | A | 7/2004 |
| JP | 2010132394 | A | 6/2010 |
| WO | 9958752 | A1 | 11/1999 |

OTHER PUBLICATIONS

Written Opinion issued in Intl. Appln. No. PCT/JP2016/055259 dated Apr. 5, 2016.

Matubara et al. "Analysis Approach for Stitch Construction and Stitch Tightening of Lock Stitch Sewing Machine." Journal of the Society of Fiber Science and Technology. 1984:39-46. vol. 40, No. 10. Cited in Specification. English abstract provided.

Extended European Search Report issued in European Appln. No. 16755481.5 dated Jul. 11, 2018.

Office Action issued in Chinese Appln. No. 201680012280.5 dated Jun. 4, 2019. English translation provided.

* cited by examiner

START OF SEWING

| STITCH NO. | Ks | STITCH NO. | Ks | STITCH NO. | Ks | STITCH NO. | Ks | STITCH NO. | Ks |
|---|---|---|---|---|---|---|---|---|---|
| 1 | 50 | 51 | 21 | 101 | 23 | 151 | 23 | 201 | 21 |
| 2 | 60 | 52 | 20 | 102 | 23 | 152 | 24 | 202 | 21 |
| 3 | 69 | 53 | 21 | 103 | 22 | 153 | 24 | 203 | 23 |
| 4 | 72 | 54 | 22 | 104 | 21 | 154 | 24 | 204 | 23 |
| 5 | 81 | 55 | 21 | 105 | 20 | 155 | 24 | 205 | 23 |
| 6 | 66 | 56 | 21 | 106 | 19 | 156 | 24 | 206 | 23 |
| 7 | 52 | 57 | 21 | 107 | 21 | 157 | 23 | 207 | 22 |
| 8 | 41 | 58 | 20 | 108 | 21 | 158 | 23 | 208 | 22 |
| 9 | 28 | 59 | 21 | 109 | 22 | 159 | 21 | 209 | 23 |
| 10 | 26 | 60 | 22 | 110 | 22 | 160 | 21 | 210 | 23 |
| 11 | 24 | 61 | 23 | 111 | 21 | 161 | 20 | 211 | 22 |
| 12 | 22 | 62 | 23 | 112 | 22 | 162 | 19 | 212 | 21 |
| 13 | 21 | 63 | 20 | 113 | 21 | 163 | 21 | 213 | 21 |
| 14 | 20 | 64 | 20 | 114 | 22 | 164 | 20 | 214 | 20 |
| 15 | 20 | 65 | 19 | 115 | 22 | 165 | 21 | 215 | 21 |
| 16 | 21 | 66 | 19 | 116 | 23 | 166 | 21 | 216 | 21 |
| 17 | 20 | 67 | 21 | 117 | 22 | 167 | 21 | 217 | 20 |
| 18 | 21 | 68 | 21 | 118 | 22 | 168 | 22 | 218 | 22 |
| 19 | 22 | 69 | 21 | 119 | 22 | 169 | 22 | 219 | 24 |
| 20 | 21 | 70 | 21 | 120 | 22 | 170 | 23 | 220 | 23 |
| 21 | 22 | 71 | 22 | 121 | 21 | 171 | 23 | 221 | 22 |
| 22 | 21 | [illegible] | 22 | 122 | 22 | 172 | 23 | 222 | 22 |
| 23 | 21 | [illegible] | 23 | 123 | 22 | 173 | 24 | 223 | 20 |
| 24 | 20 | 74 | 25 | 124 | 24 | 174 | 24 | 224 | 19 |
| 25 | 20 | 75 | 28 | 125 | 25 | 175 | 22 | 225 | 9 |
| 26 | 20 | 76 | 32 | 126 | 25 | 176 | 23 | 226 | 12 |
| 27 | 20 | 77 | 33 | 127 | 25 | 177 | 22 | 227 | 15 |
| 28 | 21 | 78 | 32 | 128 | 24 | 178 | 22 | 228 | 19 |
| [illegible] | 21 | 79 | 30 | 129 | 25 | 179 | 23 | 229 | 33 |
| [illegible] | 19 | 80 | 27 | 130 | 23 | 180 | 22 | 230 | 31 |
| [illegible] | 18 | 81 | 26 | 131 | 22 | 181 | 22 | 231 | 28 |
| 32 | 16 | 82 | 24 | 132 | 22 | 182 | 22 | 232 | 27 |
| 33 | 13 | 83 | 22 | 133 | 21 | 183 | 23 | 233 | 24 |
| 34 | 13 | 84 | 20 | 134 | 22 | 184 | 24 | 234 | 24 |
| 35 | 13 | 85 | 19 | 135 | 25 | 185 | 25 | 235 | 24 |
| 36 | 8 | 86 | 20 | 136 | 25 | 186 | 24 | 236 | 22 |
| 37 | 10 | 87 | 20 | 137 | 23 | 187 | 24 | 237 | 23 |
| 38 | 10 | 88 | 21 | 138 | 23 | 188 | 24 | 238 | 22 |
| 39 | 7 | 89 | 22 | 139 | 21 | 189 | 24 | 239 | 22 |
| 40 | 12 | 90 | 21 | 140 | 20 | 190 | 24 | 240 | 23 |
| 41 | 14 | 91 | 21 | 141 | 20 | 191 | 25 | 241 | 23 |
| 42 | 16 | 92 | 22 | 142 | 20 | 192 | 26 | 242 | 21 |
| 43 | 20 | 93 | 23 | 143 | 20 | 193 | 24 | 243 | 21 |
| 44 | 21 | 94 | 22 | 144 | 20 | 194 | 25 | 244 | 21 |
| 45 | 19 | 95 | 24 | 145 | 20 | 195 | 24 | 245 | 21 |
| 46 | 19 | 96 | 22 | 146 | 20 | 196 | 24 | 246 | 21 |
| 47 | 19 | 97 | 21 | 147 | 21 | 197 | 24 | 247 | 19 |
| 48 | 19 | 98 | 21 | 148 | 21 | 198 | 24 | 248 | 18 |
| 49 | 20 | 99 | 20 | 149 | 22 | 199 | 23 | 249 | 17 |
| 50 | 20 | 100 | 21 | 150 | 23 | 200 | 22 | 250 | 18 |

FIG. 7

SEWING QUALITY CONTROL IN SEWING MACHINE

TECHNICAL FIELD

The present invention relates generally to sewing machines which perform stitch sewing and embroidery sewing on sewing workpieces by interlacing or entwining upper and lower threads together. More particularly, the present invention relates to an improved sewing machine which permits quality control of finished sewn products by evaluating degree of stitch tightness of the sewn products, as well as a method and program for sewing quality control.

BACKGROUND ART

In sewing, sewing conditions vary depending on how tension of a lower thread is adjusted. Particularly, if tension of an upper thread is too great, the lower thread would be pulled out over a fabric, while, if the tension of the upper thread is too small, thread tightness becomes insufficient, which would result in a bad-looking stitch. Therefore, it has heretofore been conventional to perform sewing operation while appropriate adjusting the tension of the upper thread. Patent Literature 1 identified below, for example, discloses a technique which detects tension of the upper thread by means of an upper thread tension sensor and adjusts the tension of the upper thread on the basis of the thus-detected tension value so as to control the upper thread tension and thereby achieve a desired sewing finish. Non-patent Literature 1 identified below, on the other hand, discloses analyzing a rate of stitch tightness by skeleton-modeling a stitch structure and then deriving relationship between the rate of stitch tightness and the upper thread tension. Further, Patent Literature 2 and Patent Literature 3 identified below disclose a technique which achieves a desired sewing finish by calculating a consumed quantity of the upper thread (upper thread consumption quantity) per stitch on the basis of a stitch length corresponding to a desired embroidery pattern, fabric thickness and target stitch tightening allowance and then performing compulsory upper thread pay-out control using the calculated upper thread consumption quantity as a target value. In other words, the inventions disclosed in Patent Literature 2 and Patent Literature 3 are each arranged to, on the basis of the principles disclosed in Non-patent Literature 1, pre-calculate an ideal pay-out quantity per stitch of the upper thread and perform the compulsory upper thread pay-out control corresponding to the pre-calculated ideal pay-out quantity.

However, according to the disclosure of Patent Literatures 1 to 3 etc., no evaluation is made of degree of stitch tightness in an actually sewn product (or actual finished sewn product). Further, the technique disclosed in Non-patent Literature 1 too merely analyzes the relationship between the rate of stitch tightness and the upper thread tension and does not determine or evaluate acceptability/non-acceptability of the degree of stitch tightness in the actually sewn product. Particularly, when the upper thread has failed to be captured by a hook, there would occur stitch skipping and hence a defective stitch or stitches, or when a breakage has occurred in the upper and/or lower thread, a detective product would result if such a breakage is overlooked. Thus, the conventionally-known techniques cannot inspect such a defective stitch and defective product.

PRIOR ART LITERATURE

Patent Literature

Patent Literature 1: Japanese Patent Application Laid-open Publication No. HEI-8-224391

Patent Literature 2: Japanese Patent Application Laid-open Publication No. 2003-164686

Patent Literature 3: Japanese Patent Application Laid-open Publication No. 2003-305288

Non-Patent Literature

Non-patent Literature 1: "ANALYSIS APPROACH FOR STITCH CONSTRUCTION AND STITCH TIGHTNING OF LOCK STITCH SEWING MACHINE" by Toru Matubara and Yasuo Jinbo, Journal of the Society of Fiber Science and Technology, Vol. 40, No. 10 (1984), pp. 39-46

SUMMARY OF INVENTION

In view of the foregoing prior art problems, it is an object of the present invention to permit evaluation of sewing quality using a stitch tightness index.

The present invention provides a sewing machine for performing sewing on a sewing workpiece based on sewing pattern data, the sewing machine comprising: a detector that detects a used length of an upper thread per stitch or per plurality of stitches during sewing operation of the sewing machine; a processor configured to calculate, during the sewing operation of the sewing machine, a stitch tightness index per sewn stitch or per plurality of sewn stitches based on: a stitch length per stitch or per plurality of stitches defined by the sewing pattern data; a fabric thickness of the sewing workpiece; and detected data of the used length of the upper thread per stitch or per plurality of stitches; and an output device that makes notification corresponding to the calculated stitch tightness index per sewn stitch or per plurality of sewn stitches.

According to the present invention, a stitch tightness index per sewn stitch or per plurality of sewn stitches (i.e., finished sewn stitches is calculated on the basis of the stitch length per stitch or per plurality of stitches defined by the sewing pattern data; the fabric thickness of the sewing workpiece; and detected data of the used length of the upper thread per stitch or per plurality of stitches. Thus, a stitch tightness index is obtained per sewn stitch or per plurality of sewn stitches. Thus, by notification corresponding to the stitch tightness index per sewn stitch or per plurality of sewn stitches calculated as above being made as appropriate, a user can evaluate the degree of stitch tightness per stitch or per plurality of stitches on an actual finished sewn product, and the user can use, as appropriate, the calculated stitch tightness index per sewn stitch or per plurality of sewn stitches with a view to contributing to an enhanced sewing quality.

In one embodiment of the invention, the processor may be further configured to: set a reference value of the stitch tightness index in accordance with a desired sewing quality; and determine acceptability/non-acceptability of stitch tightness based on a comparison between the calculated stitch tightness index per sewn stitch or per plurality of sewn stitches and the reference value, and the output device may notify a determination result of the acceptability/non-acceptability of stitch tightness. In this way, a determination can be made as to whether there has occurred any sewing defect.

Upon determination that there has occurred a sewing defect, a warning notification is output to a human operator to prompt the human operator to take necessary steps. As a result, the present invention can provide good products free of stitch skipping and defective stitch tightening.

In one embodiment of the present invention, the sewing machine may further comprise a memory that stores the stitch tightness index per sewn stitch or per plurality of sewn stitches in association with a finished sewn product like an embroidery product. Because stitch tightness indexes per sewn stitch or per plurality of sewn stitches are stored in the memory in association with individual finished sewn products, appropriate quality control can be performed on the individual finished sewn products. For example, by provision of a determination device that determines, based on a ratio between the stored stitch tightness index per sewn stitch or per plurality of sewn stitches in the finished sewn product and a reference value, acceptability/non-acceptability of stitch tightness in the finished sewn product, it is possible to readily perform automatic inspection (i.e., unmanned digital inspection) on the individual finished sewn products.

Further, in one embodiment of the present invention, the sewing machine may further comprise a communication interface that transmits, via a communication network, the calculated stitch tightness index per sewn stitch or per plurality of sewn stitches to a host computer. Thus, by connecting to the host computer a plurality of the sewing machines of the present invention and by the host monitoring computer monitoring stitch tightness indexes sent in real time from the individual sewing machines, production progress, trouble occurrence frequency, production efficiency of the individual sewing machines, etc. can be collectively controlled.

BRIEF DESCRIPTION OF DRAWINGS

FIG. 7 is a list showing, in numerical values, stitch tightness indexes calculated for the actual example fabric according to one embodiment of the present invention.

DESCRIPTION OF EMBODIMENTS

Figure 1:
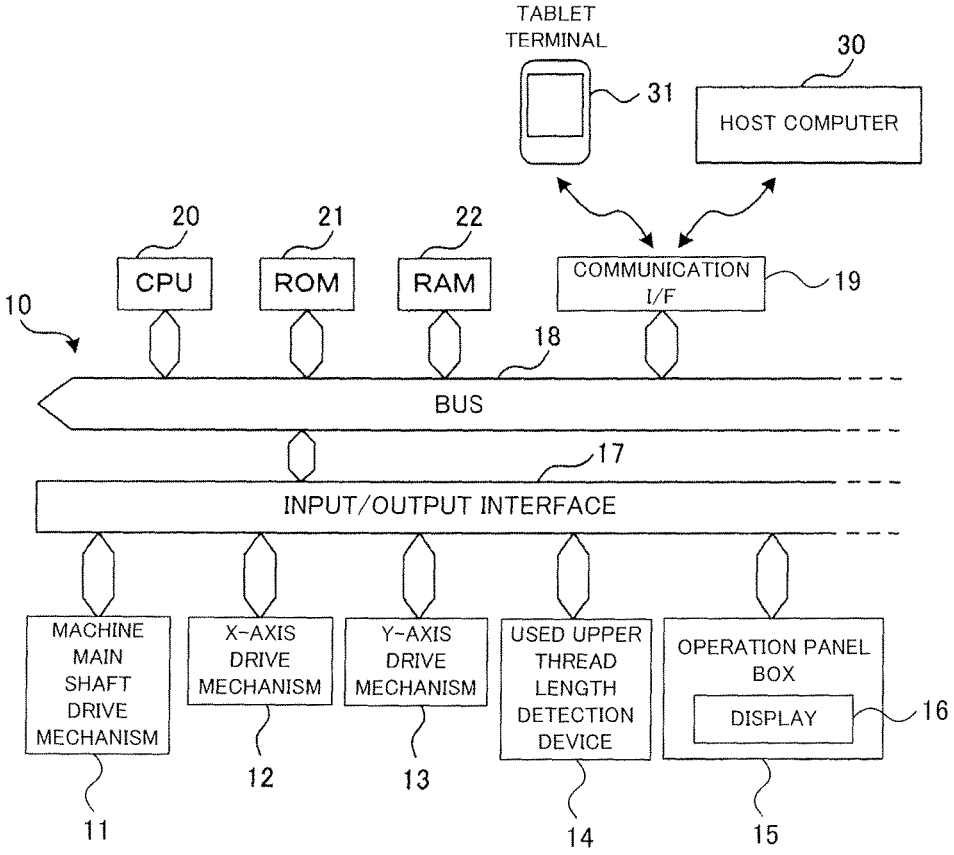
FIG. 1 is a block diagram schematically showing a system configuration of an embroidery sewing machine as an example of a sewing machine according to an embodiment of the present invention.

FIG. 1 is a block diagram schematically showing a system configuration of an embroidery sewing machine 10 according to an embodiment of the present invention. The embroidery sewing machine 10 may be of any conventionally-known mechanical construction, such as that of a pattern seamer, and thus, illustration of the mechanical construction of the embroidery sewing machine 10 is omitted here. The embroidery sewing machine 10 may be either a single-head embroidery sewing machine provided with only one sewing head or a multi-head embroidery sewing machine with a plurality of sewing heads. As known in the art, the embroidery sewing machine 10 includes a machine main shaft drivable to rotate by means of a machine main shaft drive mechanism 11. By a needle bar (not shown) of each of the sewing heads being driven vertically in an up-down direction in response to the rotation of the main shaft, an upper thread attached to the needle bar and a lower thread set on a lower thread hook are entwined together (or interlaced) to perform sewing on an embroidering workpiece (fabric). As also known in the art, the embroidery sewing machine 10 includes an embroidery frame (not shown) that is driven in X and Y directions (two-dimensional directions) by means of an X drive mechanism 12 and a Y drive mechanism 13 in accordance with embroidery sewing pattern data. The embroidering workpiece (fabric) is set on the embroidery frame, and stitches having lengths and orientations corresponding to the embroidery sewing pattern data are formed onto the embroidering workpiece (fabric) through cooperation between the vertical driving of the needle bar and the X-Y (two-dimensional) driving of the embroidery frame.

As also known in the art, the embroidery sewing machine 10 includes thread take-up levers (not shown) provided in corresponding relation to the individual needle bars. During sewing operation, tensional force is produced in the upper thread paid out from an upper thread bobbin (not shown), threaded through the thread take-up lever and reaching the distal end of the needle bar. As also known in the art, the embroidery sewing machine 10 includes an upper thread tension adjustment mechanism (not shown) such that the tensional force acting on the upper thread can be adjusted via the upper thread tension adjustment mechanism. Further, adjusting the tensional force acting on the upper thread by means of the upper thread tension adjustment mechanism as above (or controlling a per-stitch paid-out quantity of the upper thread) art adjust degree of stitch tightness (i.e., tightness between the upper and lower threads). The degree of stitch tightness is adjustable in accordance with the material and thickness (fabric thickness) of the embroidering workpiece, form or style of the embroidery (running stitch, satin stitch, or the like), etc.

Further, in FIG. 1, a used upper thread length detection device 14 is a detector that detects a used length of the upper thread per stitch or per predetermined plurality of stitches during embroidery sewing operation. For example, the used upper thread length detection device 14 is constructed to detect, by means of an absolute rotation sensor, a rotated amount (absolute rotational position) of a rotor disposed on a pathway of the upper thread and having the upper thread wound thereon. Because the rotor rotates in accordance with a used. (consumed) quantity of the upper thread, it is possible to detect a used length (quantity) of the upper thread per stitch or per plurality of stitches by detecting a rotated amount (absolute rotational position) of the rotor. In the illustrated example, the sum of a detected value of the used length of the upper thread (used upper thread length) in a current stitch and a detected value of the used upper thread length in the immediately preceding stitch is generated as a detected value of the used upper thread length in the successive two stitches.

Further, in FIG. 1, an operation panel box 15 is operable by a user to make various settings, instructions, etc. necessary for control of the embroidery sewing operation, and the operation panel box 15 includes a touch-panel type display 16. The above-mentioned various devices and mechanisms are connected to a bus 18 of a computer via an input/output interface 17. The computer includes a CPU (processor) 20, a ROM (Read-Only Memory) 21, a RAM (Random Access Memory) 22, etc. and may further include, as necessary, non-volatile memories, such as a flash memory and a hard disk. Computer programs for performing processing according to an embodiment of the present invention are prestored in the memories, such as the ROM 21 and RAM 22, and these programs are executed by the CPU (processor) 20. Further, a communication interface (I/F) 19 is connected to the computer bus 18 so that it is capable of communicating with an external host computer 30 via, a communication network. Note that a plurality of the embroidery sewing machines 10 of the present invention can be communicatively connected to the single host computer 30 via the communication network. Further, a tablet terminal 31 portable by the user can communicate with the embroidery sewing machine 10 via the communication interface (I/F) 19. In this way, various information can be displayed on the screen of the tablet terminal 31 as welt, and desired processing (such as a determination process for product inspection) can be performed independently via the tablet terminal 31 as well.

Figure 2:
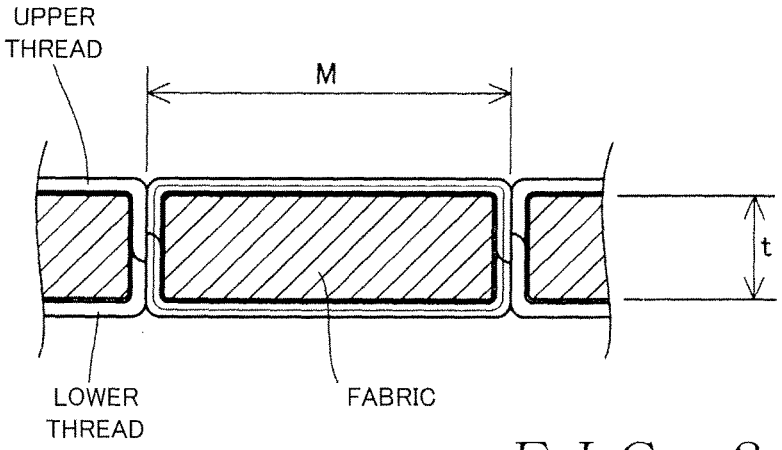
FIG. 2 is a sectional view of a finished sewn product, which is explanatory of a procedure for calculating a stitch tightness index according to the present invention.

FIG. 2 is a sectional view of a finished sewn product explanatory of a procedure for calculating a stitch tightness index Ks in accordance with the present invention, in which the section of the finished sewn product is shown as a rectangular model as disclosed in above-identified Non-patent Literature 1 etc. In the figure, "M" represents a length of one stitch (stitch length) defined by embroidery pattern data, which is in the form of a vector synthesis value between X-axis displacement data and Y-axis displacement data of the embroidery frame for the one stitch. If the X-axis displacement data is given as x and the Y-axis displacement data is given as y, then $M=\sqrt{(x^2+y^2)}$. Further, in the figure, "t" represents the fabric thickness of the embroidery sewing workpiece. If the detected value of the used upper thread length for successive two stitches is given as U, the stitch tightness index Ks is calculated in accordance with the following arithmetic expression. Let it be assumed that the stitch tightness index Ks is expressed by a value obtained by multiplying by 100 the value calculated in accordance with the following arithmetic expression (i.e. expressed in percentage).

$$Ks=1-[U/\{2(M+t)\cdot 2\}]$$

In the above arithmetic expression, "2 (M+t)" indicates the sum of the length of the upper thread and length of the lower thread in the one stitch, which is equal to two times the sum of the stitch length M and the fabric thickness t. Note that, for convenience of description, FIG. 2 shows an example where the lengths of the upper and lower threads in the one stitch are equal to each other. In the rectangular model illustrated in FIG. 2, the sum of the lengths of the upper and lower threads in the one stitch does not change from "2 (M+t)" even where the lengths of the upper and lower threads are different from each other. The reason why "(M+t)" is multiplied by "2" in the above arithmetic expression is that, because the detected value U of the used upper thread length represents a used length for successive two stitches, the sum has been adjusted to correspond to the two successive stitches. Further, the reason why the stitch tightness index Ks for the one stitch on the finished sewn product is calculated averagely using the detected value U of the used upper thread length for the successive two stitches is to allow the same arithmetic expression to be applied to both of the running stitch and the satin stitch for convenience sake. The arithmetic expression for calculating the stitch tightness index Ks is not necessarily limited to the above, and different arithmetic expressions may be used for the running stitch and for the satin stitch. For the running stitch, for example, a value u of the used upper thread length for one stitch may be obtained, and then, the stitch tightness index Ks may be calculated using an arithmetic operation of $Ks=1-[u/\{2(M+t)\}]$.

In a case where the one stitch in the finished sewn form (i.e., one finished sewn stitch) comprises almost only the upper thread (and thus the upper thread tension is loosest), the stitch tightness index Ks is about 0 (zero) (about 0 in percentage), because $U\approx\{2(M+t)\cdot 2\}$. Conversely, in a case where the one finished sewn stitch comprises almost only the lower thread (and thus the upper thread tension is tightest), the stitch tightness index Ks is about 1 (one) (about 100 in percentage), because $U\approx 0$. Further, in a case where the upper and lower threads in the one finished sewn stitch are almost equal in quantity, the stitch tightness index Ks is about 0.5 (about 50 in percentage), because $U\approx 0.5$.

Figure 3:
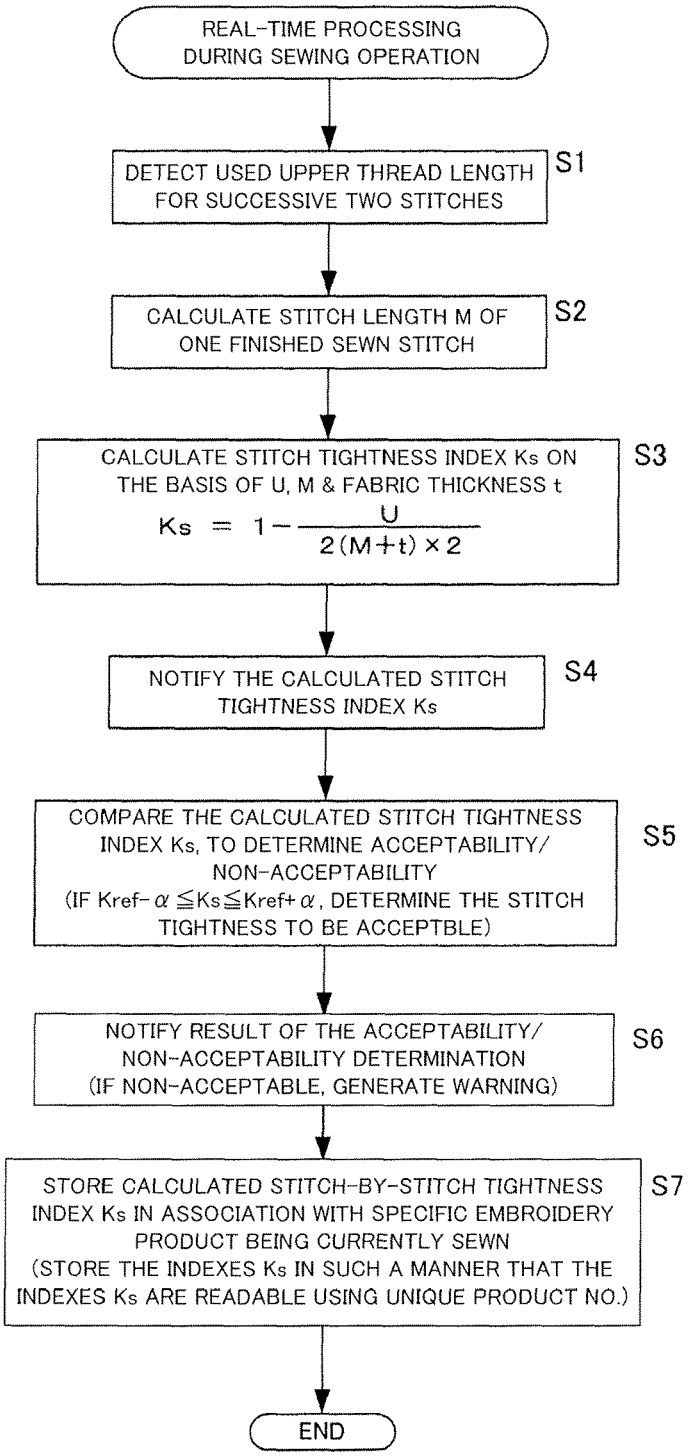
FIG. 3 is a flow chart schematically showing a control program according to one embodiment of the present invention, which particularly shows an example of real-time processing performed stitch-by-stitch sewing.

FIG. 3 is a flow chart schematically showing a control program according to one embodiment of the present invention that is executed by the CPU 20. Processing shown in FIG. 3 is real-time processing performed during stitch-by-stitch embroidery sewing operation based on embroidery pattern data. At step S1 of the processing, the sum of a detected value of the used upper thread length in a currently finished sewn stitch and a detected value of the used upper thread length in the immediately preceding sewn stitch is detected as a used upper thread length U for successive two stitches. Next, at step S2, a stitch length M of the currently finished sewn stitch defined by the embroidery pattern data is calculated. Then, at step S3, a stitch tightness index Ks for one finished sewn stitch is calculated in accordance with the aforementioned arithmetic expression on the basis of: the stitch length M defined by the embroidery pattern data; the fabric thickness t of the embroidering workpiece; and the detected value U of the used upper thread length for the successive two stitches. In the case where the sewing machine is provided with a plurality of sewing heads, a stitch tightness index Ks is calculate for each of the sewing heads. Note that information indicative of the fabric thickness t is input in advance at the start of the embroidery sewing by the user via the operation panel box 15.

Figure 4:
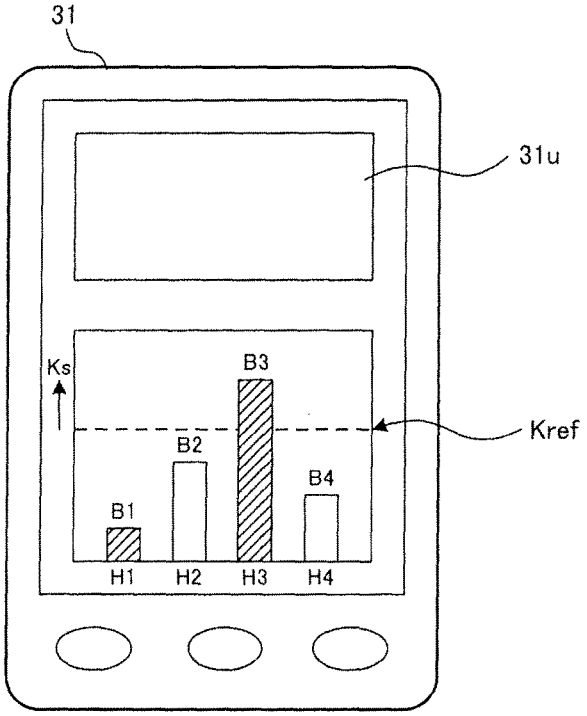
FIG. 4 is a diagram showing an example display on a tablet terminal.

At next step S4, notification is made which corresponds to the calculated stitch tightness index Ks per sewn stitch. Such notification may be made either visibly (e.g., through electronic display or printout) or audibly (e.g., through sound output). As an example, the stitch tightness index Ks for the currently finished sewn stitch is displayed in real time by an analog bar graph on the display 16 or on the tablet terminal 31 in parallel for the individual sewing heads. FIG. 4 shows an example where the stitch tightness indexes Ks for respective one stitches of the individual sewing heads H1 to H4 are displayed in real time by bars B1 to B4 of an analog bar graph on the tablet terminal 31. The bars B1 to B4 vary in length in real time in accordance with the stitch-by-stitch stitch tightness indexes Ks. As another example, the stitch tightness index Ks for the currently finished sewn stitch may be displayed in real time by a digital numerical value on the display 16 (or on the tablet terminal 31) in parallel for the individual sewing heads. By sensing or recognizing the notification, the user (human operator/administrator of the embroidery sewing machine 10) can check degree of the stitch-by-stitch stitch tightness of the finished sewn product. In this case, a combination of the hardware components, such as the display 16, tablet terminal 31, printer or speaker, etc., and the processor that performs the operation of step S4 (and/or the operation of subsequent step S6) functions as an output device that makes notification corresponding to the calculated stitch tightness index per sewn stitch or per plurality of sewn stitches of the finished sewn product.

Then, at step S5, the stitch tightness index Ks for one finished sewn stitch calculated at step S4 is compared against a preset reference value Kref of the stitch tightness index Ks, so that acceptability/non-acceptability of the stitch tightness is determined on the basis of a result of the comparison. For such determination, a reference range Kref±α is set by dead zones±α being set above and below the reference value Kref. If the calculated stitch tightness index Ks is within the reference range Kref±α, the stitch tightness is determined to be acceptable, while, if the calculated stitch tightness index Ks is outside the reference range Kref±α, the stitch tightness is determined to be unacceptable. Namely, the stitch tightness index Ks satisfying a condition of (Kref−α)≤Ks≤(Kref+α) indicates acceptable or good stitch tightness. Note that, because the stitch tightness indicating a good sewn state differs among the stitch styles (running stitch, satin switch, etc.), the reference value Kref of the stitch tightness index is set at different values depending on the stitch styles (running stitch, satin switch, etc.). For example, because it is desirable that the stitch tightness of the running stitch achieve an appropriately firm sewn state, the reference value Kref of the stitch tightness index for the running stitch is set at a relatively great value. Further, because it is desirable that the stitch tightness of the satin stitch achieve a soft sewn state, the reference value Kref of the stitch tightness index for the satin stitch is set at a relatively small value. Also note that the reference value Kref may be preset at the start of the embroidery sewing by the user via the operation panel box 15 and/or the like. Further, in a case where the stitch style changes from one to another in the middle of one embroidery pattern (from the running stitch to the satin stitch, or vice versa), the setting of the reference value Kref is changed in the middle of the embroidery pattern. As still another example, respective reference values Kref may be preset for the running stitch and the satin stitch, and it may be automatically determined, on the basis of the embroidery pattern data, which of the running stitch and the satin stitch the current stitch style is, and the reference value Kref corresponding to the determined stitch style may be used for the comparison at step S5. Because the internal angle of adjoining stitches is extremely small in the case of the satin stitch, it is possible to readily distinguish between the running stitch and the satin stitch by calculating the internal angle of adjoining stitches from the embroidery pattern data. Further, the value of the dead zones co, too can be set by the user via the operation panel box 15 and/or the like.

At next step S6, notification is made which corresponds to the result of the acceptability determination at step S5. Such notification too may be made either visibly (e.g., through electronic display or printout) or audibly (e.g., through sound output). The notification is made using a display function of the display 16 or tablet terminal 31 and/or a sound generation function belonging to the display function. In the illustrated example of FIG. 4, a horizontal line (broken line in the figure) indicative of a level of the reference value Kref is displayed on an area of the tablet terminal 31 where the stitch tightness indexes Ks for respective one stitches of the sewing heads H1 to H4 are displayed by the bars B1 to B4 of the analog bar graph, so that the user etc. can visually understand what relationship with the line of the reference value Kref the bars B1 to B4 are in. In one implementation, the bars B1 to B4 may be displayed in different colors in accordance with acceptability and non-acceptability of the corresponding stitch tightness indexes Ks. More specifically, in the illustrated example of FIG. 4, the hatched bars B1 and B3 are displayed in a predetermined color (e.g., red) indicative of the non-acceptability, while the non-hatched bars B2 and B3 are displayed in another color (e.g., green) indicative of the acceptability. Further, predetermined warning sound may be generated in correspondence with the non-acceptability-indicating bars B1 and B3.

The, at step S7, the stitch-by-stitch stitch tightness indexes Ks calculated as above are stored into a storage device (e.g., RAM 22) in association with a specific embroidery product being currently sewn. Namely, such stitch-by-stitch stitch tightness indexes Ks are stored together in a file in such a manner that they can be read out using a unique product number (or ID) assigned to the specific embroidery product. Thus, once the sewing operation is completed on the specific embroidery product, the stitch-by-stitch stitch tightness indexes Ks for all of the stitches of the specific embroidery product (unique product number) are stored together in a file into the storage device. In this manner, the stitch-by-stitch stitch tightness indexes Ks for all of the stitches are accumulated into the storage device in respective files for all of individual embroidery products made by the embroidery sewing machine 10.

Figure 5:
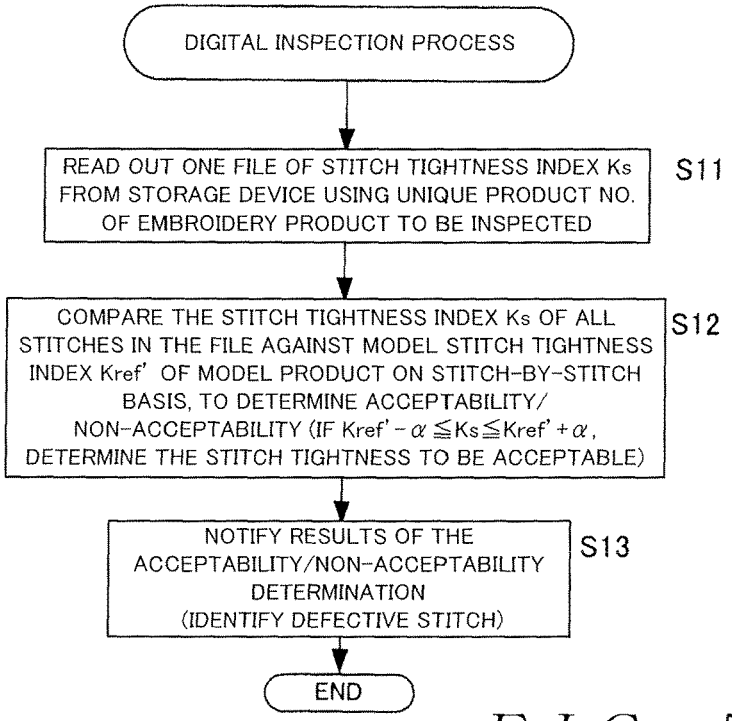
FIG. 5 is a flow chart schematically showing a control program according to one embodiment of the present invention, which particularly shows an example of a digital inspection process performed after completion of a sewing operation.

FIG. 5 is a flow chart schematically showing a control program according to one embodiment of the invention performed by the CPU 20, which particularly shows an example of a digital inspection process performed after completion of the embroidery sewing. First, at step S11, one file of stitch tightness indexes Ks is read out in accordance with the product number of the embroidery product to be inspected.

At next step S12, the stitch tightness indexes Ks for all the stitches in the read-out file are compared against model stitch tightness indexes (reference values) Kref' of all stitches of a model good or acceptable product prepared in advance on a stitch-by-stitch basis, so as to determine acceptability/non-acceptability per stitch. For such determination, a reference range Kref'±α is set by dead zones±α being set above and below stitch tightness indexes (reference values) Kref' of corresponding stitches, as at step S5 of FIG. 3. If the stitch tightness index Ks for a stitch of the product to be inspected is within the reference range Kref'±α, the stitch tightness of that stitch is determined to be acceptable, while, if the stitch tightness index Ks for a stitch is outside the reference range Kref'±α, the stitch tightness of that stitch is determined to be unacceptable. Namely, the stitch tightness index Ks satisfying a condition of (Kref'−α)≤Ks≤(Kref'+α) indicates acceptable stitch tightness.

At next step S13, notification is made which corresponds to the result of the acceptability/non-acceptability determination at step S12. If there is any stitch whose stitch tightness index Ks is non-acceptable, information identifying such a defective stitch is notified. Such notification too may be made either visibly (e.g., through electronic display or printout) or audibly (e.g., through sound output). Namely, desired notification may be made through the display function of the display 16, electronic data output and/or paper printout identifying the defective stitch, and/or the like. In this way, digital inspection can be performed on all stitches of all products.

When the CPU 20 of the sewing machine 10 performs the digital inspection process shown in FIG. 5, the CPU 20 functions as a determination device that determines acceptability/non-acceptability of stitch tightness of a finished sewn product on the basis of a comparison between the stored stitch tightness index per stitch or per plurality of stitches and the reference value. Such a determination device may be implemented by other means than the CPU 20 of the sewing machine 10, such as another computer (like a suitable personal computer) or control device. For example, the tablet terminal 31 may be caused to function as the determination device (device that performs the digital inspection process shown in FIG. 5).

Figure 6:
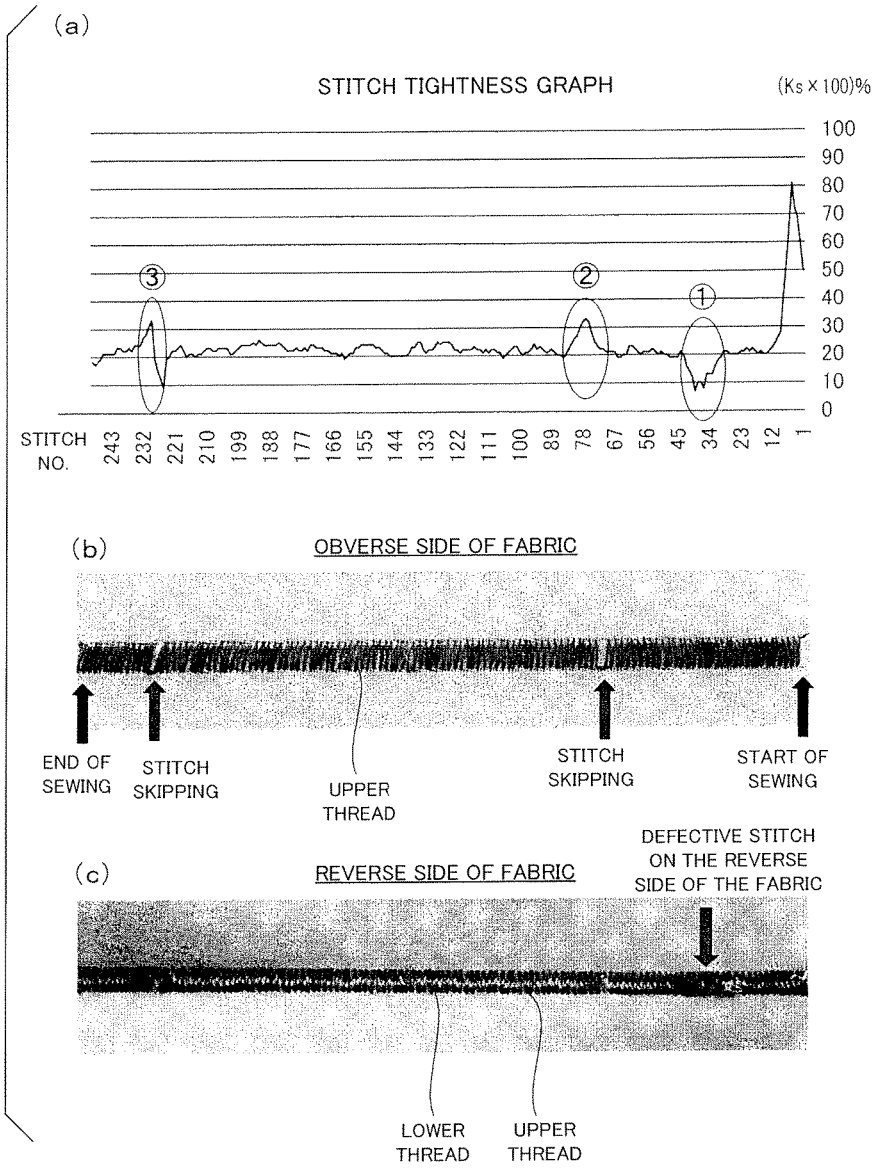
FIG. 6 is a diagram-substituting photograph explanatory of the embodiment of the present invention in accordance with an actual example of sewing, of which (a) is a chart showing, in a line graph, stitch tightness indexes calculated for an actual example fabric sewn with the satin stitches, (b) is a drawing-substituting photograph showing the obverse (front) side of the fabric sewn with satin stitches, and (c) is a drawing-substituting photograph showing the reverse (back) side of the fabric sewn with the satin stitches.

The following describe the embodiment of the present invention in relation to an actual example of sewing. FIG. 6(*b*) is a photograph showing the obverse (front) side of a fabric on which sewing of satin stitches of a predetermined stitch width has been completed, while FIG. 6(*c*) is a photograph showing the reverse (back) side of the fabric. In FIG. 6(*c*), a thread of a thick color is an upper thread, and a thread of a thin color is a lower thread. The sewing here is trial or test sewing consisting of a total of 250 stitches. The sewing has been performed in such a manner that degree of stitch tightness suitable for the satin stitches is achieved through a conventionally-known upper thread tension adjustment mechanism. In the sewing operation, the above-described embodiment of processing (such as the real-time processing of FIG. 3) is applied to store a stitch tightness index Ks calculated per stitch into one file. In the case where the real-time processing of FIG. 3 is applied to the actual example, the aforementioned operations of steps S5 and S6 (acceptability/non-acceptability determination) may be omitted. FIG. 7 is a list showing one file of stitch tightness indexes Ks actually calculated during the sewing operation in correspondence with the actual example of sewing shown in FIG. 6(*b*). FIG. 6(*a*) is a chart showing the one file of stitch tightness indexes Ks plotted in a line graph on the basis of the list of FIG. 7. The graph of FIG. 6(*a*) is plotted with substantially the same scale as FIGS. 6(*b*) and 6(*c*) to facilitate comparisons with the photographs of the actual example of sewing shown in FIGS. 6(*b*) and 6(*c*).

Overall, it can been seen that, for a stitches where the stitch tightness index is in a range of about 20 to 25, proper sewing is performed with no defect occurring in the sewing finish, and that, for switches where the stitch tightness index is greater or smaller than that range, improper sewing is performed.

In FIG. 6(*c*), a defective sewn portion can be visually recognized on the reverse side of the finished sewn fabric. This defective sewn portion corresponds to a portion indicated at (1) in the graph of FIG. 6(*a*) and a portion of 32nd to 42nd stitches indicated at (1) in the list of FIG. 7. In the portion indicated at (1) in the list of FIG. 7, the stitch tightness index Ks lowered to 16 or less because much of the upper thread ran around to and was consumed on the reverse side (the used upper thread quantity U was great).

Further, in FIG. 6(*b*), two stitch-skipped portions (deficiencies) can be visually recognized on the obverse side of the finished sewn fabric. The first stitch-skipped portion in FIG. 6(*b*) corresponds to a portion indicated at (2) in the graph of FIG. 6(*a*) and a portion of 75th to 81st stitches indicated at (2) in the list of FIG. 7. In the portion indicated at (2) in the list of FIG. 7, the so-called stitch skipping occurred with no stitch formed because the upper thread failed to be captured and pulled by the point portion of the hook. In this case, the upper thread consumption quantity was small (U was small), and the stitch tightness index Ks is high (26 or over). The second stitch-skipped portion in FIG. 6(*b*) corresponds to a portion indicated at (3) in the graph of FIG. 6(*a*) and a portion of 229th to 232nd stitches indicated at (3) in the list of FIG. 7. In the portion indicated at (3) in the list of FIG. 7 too, the stitch skipping occurred, the upper thread consumption quantity was small (U was small), and the stitch tightness index Ks was high (27 or over). Note that, in a portion of 225th to 227th stitches preceding the (3) portion, the upper thread was consumed much, and the stitch tightness index Ks lowered to 15 or less. Thus, it can be considered that some defect occurred in the 225th-to-227th portion too, and it can also be considered that this defect led to the defect in the (3) portion.

From the foregoing, it can be seen that there is a clear relativity between the sewing quality and the stitch tightness index Ks. For a particular embroidery pattern, optimal settings of upper thread stitch performation can be found by performing test sewing as shown in FIGS. 6 and 7 and calculating stitch tightness indexes Ks during the test sewing. Namely, as shown in FIGS. 6 to 7, the stitch performation set in the test sewing can be changed to more optimal one, as appropriate, on the basis of visual comparison between test-sewn stitch samples and the list of stitch tightness indexes Ks calculated during the test sewing. Then, test sewing and calculation of stitch tightness indexes Ks is performed again, as shown in FIGS. 6 and 7, in accordance with the changed stitch performation, and visual comparison is made between test-sewn stitch samples and the stitch tightness indexes Ks calculated during the test sewing. If such operations can eliminate or reduce defects, embroidery products can be mass-produced with uniform quality by subsequently performing sewing of the particular embroidery pattern using the changed stitch formation settings.

As another application of the present invention, sewing operation (test sewing) may be actually performed several times for a particular embroidery pattern in such a manner as described above with reference to FIGS. 6 and 7, so as to statistically or empirically obtain, through trial and error, a center value of an optimal stitch tightness index Ks and upper and lower limit values of defective stitch tightness indexes Ks. In the illustrated example of FIG. 7, the center value of the optimal stitch tightness index Ks is "21", and the stitch tightness indexes Ks equal to or smaller than "16" and equal to or greater than "26" are determined to be defective. The reference value Kref to be used in the comparative determination at step S5 for the particular embroidery pattern is set, for example, at "21", and the dead zone±α is set, for example, at "±5". After that, in mass-producing products of the particular embroidery pattern, the processing of the present invention as shown in FIGS. 3 and 5 can be performed using the reference value Kref and dead zone±α set as above. The reference value Kref and dead zone±α set on the basis of statistical and empirical values in the aforementioned manner may be stored together with pattern data of the particular embroidery pattern so that the pattern data can be read out and automatically set when the embroidery sewing operation is to be performed. Further, the reference value Kref and dead zone±α automatically set in this manner may be changed by the user as necessary.

As stated above in relation to FIG. 1, a plurality of the embroidery sewing machines 10 of the present invention can be communicatively connected to the single host computer 30 via the communication network. Thus, production progress, trouble occurrence frequency, production efficiency of the individual sewing machines 10, etc. can be collectively managed or controlled by the host computer 30 monitoring stitch tightness indexes Ks sent in real time from the individual sewing machines 10.

Note that, whereas the above-described embodiment is configured to calculate a stitch tightness index Ks per stitch during sewing operation, the present invention is not so limited, and a stitch tightness index Ks may be calculated in real time in accordance with the basic principles of the present invention per group of two or more stitches during the sewing operation.

Because the sewing machine of the present invention is provided with the construction for detecting a used length of the upper length per stitch, control of the upper and lower threads can be performed using the thus-detected used length of the upper thread. First, by accumulating stitch-bye-stitch detected values of the used lengths of the upper thread, it is possible to calculate an accumulated used quantity of the upper thread for each of color thread bobbins provided in corresponding relation to individual needles. Such an accumulated used quantity of the upper thread can be notified to the user by being displayed on an upper display area of the tablet terminal 31 as shown, for example, in FIG. 4. Further, there is achieved another advantage that the accumulated used quantity of the upper thread obtained as above can be used as a guide for ordering a thread as a product-producing material. Further, it is possible to estimate a used length of the lower thread on the basis of the detected value of the used length of the upper thread per stitch. By accumulating detected values of the used length of the lower thread, it is possible to calculate an accumulated used quantity of the lower thread for each of lower thread bobbins. Because timing for replacing the lower thread bobbin with another can be known on the basis of the accumulated used quantity of the lower thread, efficient embroider product production can be achieved by incorporating a bobbin changer in the sewing machine of the present invention.

According to the present invention, as described above, a stitch tightness index Ks is calculated per stitch during sewing operation and compared against a predetermined reference value, so that a determination can be made as to whether there has occurred any sewing defect. Upon determination that there has occurred a sewing defect, a warning notification is output to the human operator to prompt the human operator to take necessary steps. As a result, the present invention can provide good products free of stitch skipping and thread tightening detect.

Further, although how to apply upper thread tension differs between the satin stitch and the running stitch, the present invention permits presetting of tension matching the stitch type and thus can perform embroidery comprising a mixture of the satin and running stitches.

What is claimed is:

1. A sewing machine for performing sewing on a sewing workpiece based on sewing pattern data, the sewing machine comprising:

a detector that detects a used length of an upper thread per stitch or per plurality of stitches during sewing operation of the sewing machine;

a processor configured to calculate, during the sewing operation of the sewing machine, a stitch tightness index per sewn stitch or per plurality of sewn stitches based on: a stitch length per stitch or per plurality of stitches defined by the sewing pattern data; a fabric thickness of the sewing workpiece; and detected data of the used length of the upper thread per stitch or per plurality of stitches; and an output device that makes notification corresponding to the calculated stitch tightness index per sewn stitch or per plurality of sewn stitches.

2. The sewing machine as claimed in claim 1, wherein the processor is further configured to:

set a reference value of the stitch tightness index in accordance with a desired sewing quality; and determine acceptability/non-acceptability of stitch tightness based on a comparison between the calculated stitch tightness index per sewn stitch or per plurality of sewn stitches and the reference value, and wherein the output device notifies a determination result of the acceptability/non-acceptability of stitch tightness.

3. The sewing machine as claimed in claim 1, which further comprises a memory that stores the calculated stitch tightness index per sewn stitch or per plurality of sewn stitches in association with a finished sewn product.

4. The sewing machine as claimed in claim 3, which further comprises a determination device that determines, based on a ratio between the stored stitch tightness index per sewn stitch or per plurality of sewn stitches and a reference value, acceptability/non-acceptability of stitch tightness in the finished sewn product.

5. The sewing machine as claimed in claim 1, which further comprises a communication interface that transmits, via a communication network, the calculated stitch tightness index per sewn stitch or per plurality of sewn stitches to a host computer.

6. A computer-implemented method for sewing quality control in a sewing machine that performs sewing on a sewing workpiece based on sewing pattern data, the method comprising:

detecting a used length of an upper thread per stitch or per plurality of stitches during sewing operation of the sewing machine;

calculating, during the sewing operation, a stitch tightness index per sewn stitch or per plurality of sewn stitches based on: a stitch length per stitch or per plurality of stitches defined by the sewing pattern data; a fabric thickness of the sewing workpiece; and detected data of the used length of the upper thread per stitch or per plurality of stitches; and making notification corresponding to the calculated stitch tightness index per sewn stitch or per plurality of sewn stitches.

7. A non-transitory computer-readable storage medium storing a program executable by a processor to perform a method for sew quality control in a sewing machine that performs sewing on a sewing workpiece based on sewing pattern data, the program comprising:

detecting a used length of an upper thread per stitch or per plurality of stitches during sewing operation of the sewing machine;

calculating, during the sewing operation, a stitch tightness index per sewn stitch or per plurality of sewn stitches based on: a stitch length per stitch or per plurality of stitches defined by the sewing pattern data; a fabric thickness of the sewing workpiece; and detected data of the used length of the upper thread per stitch or per plurality of stitches; and making notification corresponding to the calculated stitch tightness index per sewn stitch or per plurality of sewn stitches.

* * * * *